US007704107B1

(12) United States Patent
Desmond

(10) Patent No.: US 7,704,107 B1
(45) Date of Patent: Apr. 27, 2010

(54) CONDUCTIVE COIL CONNECTOR FOR RECONFIGURABLE ELECTRICAL CIRCUIT ELEMENT

(76) Inventor: Randall Mark Desmond, 4144 W. 164th St., Lawndale, CA (US) 90260

( * ) Notice: Subject to any disclaimer, the term of this patent is extended or adjusted under 35 U.S.C. 154(b) by 1023 days.

(21) Appl. No.: 11/430,418

(22) Filed: May 9, 2006

(51) Int. Cl.
*H01R 13/33* (2006.01)

(52) U.S. Cl. ..... 439/840; 434/224

(58) Field of Classification Search ..... 439/840; 361/760; 434/379
See application file for complete search history.

(56) References Cited

U.S. PATENT DOCUMENTS

| | | | | |
|---|---|---|---|---|
| 1,505,531 | A | 8/1924 | Bensett | |
| 2,882,514 | A | 4/1959 | Krantz | |
| 3,383,647 | A | 5/1968 | Duffield | |
| 3,638,163 | A * | 1/1972 | Loosme | 439/74 |
| 4,623,312 | A * | 11/1986 | Crawford | 434/224 |
| 4,810,213 | A * | 3/1989 | Chabot | 439/825 |
| 4,937,653 | A * | 6/1990 | Blonder et al. | 257/739 |
| 5,030,109 | A * | 7/1991 | Dery | 439/66 |
| 5,339,219 | A * | 8/1994 | Urich | 361/760 |
| 6,439,894 | B1 * | 8/2002 | Li | 439/66 |
| 6,449,167 | B1 | 9/2002 | Seymour | |
| 6,666,690 | B2 * | 12/2003 | Ishizuka et al. | 439/66 |
| 7,597,564 | B2 * | 10/2009 | Matthias et al. | 439/108 |
| 2004/0096812 | A1 * | 5/2004 | Goh et al. | 434/379 |
| 2004/0132320 | A1 * | 7/2004 | Dittmann | 439/66 |
| 2005/0243489 | A1 | 11/2005 | Seymour | |

OTHER PUBLICATIONS

Chris Bowick, book entitled "RF Circuit Design", First Published Jan. 1982 by Newnes Press, USA—Front Cover Artwork.

* cited by examiner

*Primary Examiner*—Edwin A. Leon
*Assistant Examiner*—Vanessa Girardi

(57) ABSTRACT

A configurable electrical circuit element housing used as a building block in prototyping and demonstrating electric circuits. A label (10) with a circuit element graphic (11) attaches on an electrically insulated housing top (20). Underneath is an alternating arrangement of electrically insulated connector guide walls (22) and guide posts (21) forming a square-like perimeter surrounding a circuit element (40). Circuit element leads (41) attach to bent coil connector binding posts (31) inside the housing. The bent coil connector binding posts, on sides for which they are installed, are the ends of bent coil connectors (30). The bent coil connectors bend around the guide posts forming arcs external to the square-like perimeter. The guide walls help form the arcs by pinching the bent coil connectors. The arcs of the bent coil connectors are resilient connectors which interface with similar connectors forming a bent coil connector coupling (50) interweaving their coil loops.

9 Claims, 6 Drawing Sheets

CONDUCTIVE COIL CONNECTOR FOR RECONFIGURABLE ELECTRICAL CIRCUIT ELEMENT

FEDERALLY SPONSORED RESEARCH

Not Applicable

SEQUENCE LISTING OR PROGRAM

Not Applicable

BACKGROUND

1. Field of Invention

This invention relates to electrical connectors, specifically to such electrical connectors used in electrical circuit elements for prototyping electric circuits by electrical engineers, electronic circuit enthusiasts, and students of electronics.

2. Description of Prior Art

Electric circuits are typically prototyped by attaching discrete electrical components to a breadboard. Discrete electrical components are commonly referred to as circuit elements and include, but are not limited to, resistors, capacitors, inductors, diodes, transformers, transistors, batteries, light emitting diodes, and wires. As an electric circuit is constructed, a breadboard provides a place to interconnect such circuit elements. A breadboard is typically a printed circuit board, a shorting pin breadboard, or a wire wrap breadboard. Depending on the type of breadboard, circuit elements are attached to the breadboard by soldering, circuit element lead insertion, or wire wrapping.

Electrical circuit elements are housed in insulating materials with exposed conducting contacts called leads. The broadest categories of such elements, according to lead type, are through-hole and surface mount. Both of these types of housings are intended for mass production purposes but are also used for prototyping. It would be useful if these circuit elements could be housed in a way that would facilitate faster and easier preproduction processes such as design, development and prototyping of electric circuits. It would also benefit the preproduction processes if the housing was independent of the use of any breadboard. Such independence from breadboards facilitates removal of some prototyping problems associated with typical breadboards.

In the case of a breadboard of the printed circuit board variety, an insulated surface is plated with a layout of conducting material interconnecting a plurality of plated through-holes or surface mount pads. Circuit elements are either inserted into the holes or glued into place depending on whether the circuit element is a through-hole or surface mount design. In both cases, the circuit elements are soldered into position. The process of etching a layout in the conducting material and subsequent soldering of circuit elements is time consuming. With surface mount components, the process is especially difficult due to the small sizes of the circuit elements to be soldered. Printed circuit board type of breadboards may also require the use of toxins such as when using lead based solder for soldering or when using certain chemicals required to etch a printed circuit board layout. Additionally, a circuit built using this method almost never resembles a schematic drawing of the same circuit as designed. Such a mismatch between the resulting circuit and the schematic drawing translates into difficulty for a user who needs to test and troubleshoot the resulting circuit.

In the case of breadboards that use shorting clips, each connecting wire must be inserted into the proper shorting clip as a circuit is being constructed. The shorting clips are usually very close to each other and the circuit very rarely resembles a schematic drawing of the circuit. After many parts are connected it may be difficult or even impossible to remove devices buried under the wires used to connect the circuit elements. Also, the circuit on this type of breadboard is very difficult to trace for errors. Shorting clips can loose their resiliency after much use. Also, circuit element leads can get worn through readjustment from one circuit prototype to the next.

In the case of wire wrapped breadboards, connecting together individual circuit elements is a time consuming process typically requiring a user to wire wrap each lead of each circuit element. A circuit built using this method may have many wires crossing and will most likely not resemble a schematic drawing of the circuit. Circuit elements cannot be removed easily to study the effect of such a removal or demonstrate their function.

It would be desirable to facilitate a method of electric circuit construction which would considerably reduce the time needed to construct, test, and modify a prototype circuit. It would further be preferable if such a method depended on a resilient electrical connector. Such a resilient connector would more readily connect to a similar complementary connector in order to join circuit elements together during circuit construction.

Conducting helical coils have been used in a subset of electrical connectors. Such coils can be constructed to conform to a variety of shapes when connected in a circuit. Furthermore, such coils can also resiliently preserve a predetermined shape after breaking a connection with a circuit. U.S. Pat. No. 4,810,213 to Chabot (1989) discusses the use of conducting helical coils as a method of maintaining the electrical contact of a connector in certain positions. The turns of coils provide a multiplicity of engaged surfaces acting in parallel which are free to adjust themselves independently to make good electrical contact. However, all of the arrangements which Chabot suggests present only one connector of the mating pair as having a conducting coil with the opposite side of the connection having a solid conducting surface despite the many orientations suggested.

Helical conducting coils find application as connectors between substrates. U.S. Pat. No. 5,030,109 to Dery (1991) takes the idea of helical coils as stacking connectors between interconnecting substrates. While he does point out the advantage of redundant conducting paths of the contact of the loops of the coils to circuit pads of the substrates, there is still a dependency of having circuit pads on substrates without any indication of a complementary connector similar to a conducting coil. U.S. Pat. No. 6,666,690 to Ishizuka (2003) reiterates another particular application of conducting coils between substrates with the feature of radial deformation of the coil where the benefit of such deformation is additional pressure for a stronger contact with the connecting substrates. However, there is no similar complementary coil connector to the radial deformed coil implied or suggested.

In all of the above cases discussing conducting coil connectors, the application of any conducting coil is only to one side of an electrical connection. There is no mention of any method of interfacing two conducting coils as complementary connectors to each other. It would therefore be beneficial if there was a radial deformed arrangement of conducting coils such that such a conducting coil could be connected with a similar complementary coil. Such an electrical connector would leverage the benefits of a multiplicity of redundant conducting surfaces and make use of radial deformation for a stronger contact both physically and electrically. An electrical connector with the described benefits would largely aid in the building and testing of electric circuits if combined with an appropriate electric circuit element housing and an accompanying method of constructing electric circuits.

U.S. Pat. No. 6,449,167 to Seymour (2002) is an attempt at facilitating a method of electric circuit construction which would considerably reduce the time needed to construct, test, and modify a prototype circuit for a production layout, but that invention requires circuit elements housed with magnets which are attracted to a special breadboard. The requirement of magnets can be expensive and can affect some circuit elements due to the presence of the extraneous magnetic fields. While circuit element housings using such a system can be laid out similarly to a schematic drawing of the same circuit, such a system presents confusion without a clear label depicting which circuit element is being placed on the breadboard. For example, transistors with different electrical properties often share the same type of physical housing but transistor leads are often in a reconfigured order. In any such similar case, a user may confuse the leads of a circuit element unwittingly and construct a circuit incorrectly.

Another alternative, the SNAP CIRCUITS™ circuit building system, manufactured by Elenco Electronics Inc. of Wheeling, Ill., uses snaps as connectors interconnecting circuit elements. The SNAP CIRCUITS™ system uses a matrix of preset positions on an insulator base grid for supporting placement of circuit elements in housings having the snap connectors. The base grid dictates discrete positions where circuit elements may be placed and can limit the positions of circuit elements. While this approach has circuit elements represented graphically along side the actual components in the pieces that connect with snaps, these pieces do not have uniform housings and so the result can be messy. A circuit constructed using this system may require unintended cleverness on the part of a user who needs to get unaligned sections of a circuit connected. Snaps of different sections of the circuit may be at a different heights and will not meet snaps together of physically adjacent circuit elements without extra snapping interfaces. Considering the above, the circuit constructed by this method may not even look like a layout of an original schematic diagram even though each circuit element housing in the constructed circuit has a graphic depicting the circuit element within or attached to the housing.

U.S. patent application 2004/0096812 of Goh (2004) presents a breadboard for educational purposes. The breadboard of Goh is designed to allow circuit elements housed within schematically labeled component blocks to be placed in such a way that the end result looks similar to a circuit schematic diagram. However, necessitating a breadboard is a bulky feature, and the shorting pins of the breadboard will lose resiliency over time. Additionally, the circuit built, whose sum of all the component block labels would look similar to a schematic, is forced to conform to the breadboard. This conformity to the breadboard can result in an awkward arrangement of component blocks whose resulting sum of all the component block labels looks appreciably different than the original circuit schematic diagram.

U.S. Pat. No. 4,623,312 to Crawford (1986) is an attempt to use modularly uniformed sized and labeled electric circuit element housings, or units, to build electric circuits. These modular units may be connected by means of joining units next to each other and interconnecting wires to and from various units to build a circuit. However, that invention requires the modular units to be stacked vertically in such a way as to render difficult the swapping in and out of the units. In addition, the connecting wires used to interface one unit with another can get messy by crossing over other connecting wires and obstructing the view of the labels of other units. Finally, the end result is a working electric circuit, but only marginally looking like the complete schematic which is not easily verified by quick visual check.

In all of the above cases, circuit element housings of different types of circuit elements vary in size and shape, combine together through a stacking process, or require an intervening breadboard. The variance in shape and the process of stacking circuit elements causes barriers in interfacing circuit elements when trying to construct electrical circuits quickly and with ease. A circuit element that fits in one location may not fit in another location because the space between the places where the leads connect differs in orientation or shape, or removing a circuit element and replacing it with another circuit element may involve significant deconstruction of the original circuit before being able to replace the circuit element. It would be beneficial if there was a configurable or standardized housing that could be used for a standard set of circuit elements and facilitates connections which do not depend on stacking the circuit elements.

It is even more desirable if the final layout of a prototyped circuit resembles a schematic drawing diagram of the circuit with increased accuracy while removing dependence on the use of a breadboard or other printed circuit board as the intermediary between the circuit elements either as an arrangement of conductors or simply an insulating spacer. Additionally, if each circuit element had a graphical representation affixed unto itself which corresponded directly it a connector which interfaced with not a wire or a breadboard but a complementary connector of another similarly housed circuit element, then the combination of these circuit elements could be made to look significantly similar if not identical to the schematic diagram of the electrical circuit under construction. Likewise, if circuit element housings were uniformly shaped with connectors that allowed easy swapping in and out of different circuit elements in such housings without stacking such housings, then in general the circuit construction would be easier, faster and look attractive. Additionally, circuit elements used in circuit construction would have reusability for future prototyping. Finally, if such circuit element housings were configured with resilient conducting coil connectors which interface with similar complementary connectors by way of a simple and easy insertion and extraction method, then the circuit construction process would become even easier and faster.

It is, therefore, desirable to facilitate an improved method of constructing circuits, which attains the preceding objectives and overcomes most, if not all, of the preceding problems.

OBJECTS AND ADVANTAGES

Accordingly, several objects and advantages of the present invention are to provide an electrical circuit element housing which:

(a) has an attractive visual interface depicting a circuit element being housed therein;

(b) uses resilient connectors for repeat and frequent use;

(c) is of modular design to accommodate many types of circuit elements by configuring the visual interface, the number of connectors in and around the housing, and the circuit element being housed;

(d) facilitates temporary markings on the label. Such markings as may be written by a user during the building, testing, or demonstration of a circuit build with a group of similar housings;

(e) requires no intermediate breadboard or insulated grid base;

(f) is easy and quick to connect and disconnect when constructing an electric circuit using many similar such housings for each of the circuit elements within the circuit;

(g) enables variant orientations and interfacings of similarly housed circuit elements;

(h) enables an accurate and comprehensive visual depiction of a circuit under construction when combined with similar housings to match a schematic diagram of the same circuit;

(i) makes troubleshooting easy for a circuit constructed from many similar such housings;

(j) makes the view and access to each circuit element in a circuit constructed of similar such housings unobstructed by the construction of the circuit;

(k) makes it easy to find and access test points from a schematic diagram when used with similar housings to construct a circuit; and (l) does not limit the size of a circuit constructed with similarly housed circuit elements due to dependence on a breadboard of limited size and capacity.

Further objects and advantages will become apparent from a consideration of the ensuing description and drawings.

SUMMARY

In accordance with the present invention an electrical circuit element housing comprises an insulating box-like structure, a laminated label on the top of the structure, bent conducting coil connectors on the outside perimeter of the structure and coil binding posts on the inside of the structure, and an opening at the bottom of the structure. Both the internal and external coil connectors for each side are part of the same coil. The laminated label graphic reflects the type of element being housed, and the internal and external connectors align with the label graphic.

DRAWINGS

Drawing Figures

REFERENCE NUMBERS IN DRAWINGS

Figure 1:
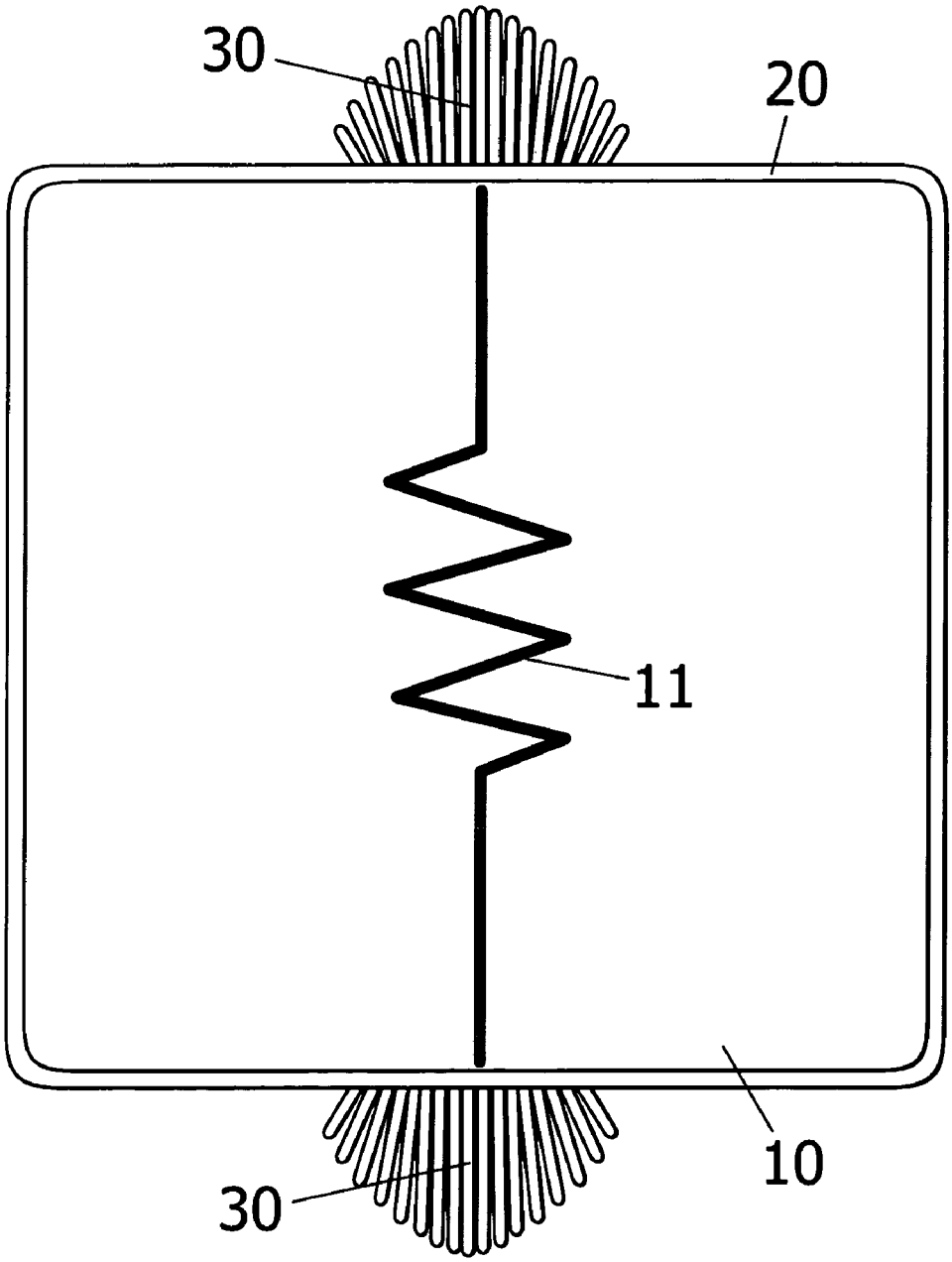
FIG. 1 shows a top view of an electrical circuit element housing depicting a resistor as an example circuit element.

10 label
11 resistor graphic
12 transistor graphic
13 three-conductors-tied-together graphic
20 insulated housing top
21 guide post
22 guide wall
30 bent coil connector
31 bent coil connector binding post
40 circuit element
41 circuit element lead
50 bent coil connector coupling

DETAILED DESCRIPTION

Description

FIGS. 1, 2, 3, and 4—Preferred Embodiment

Figure 2:
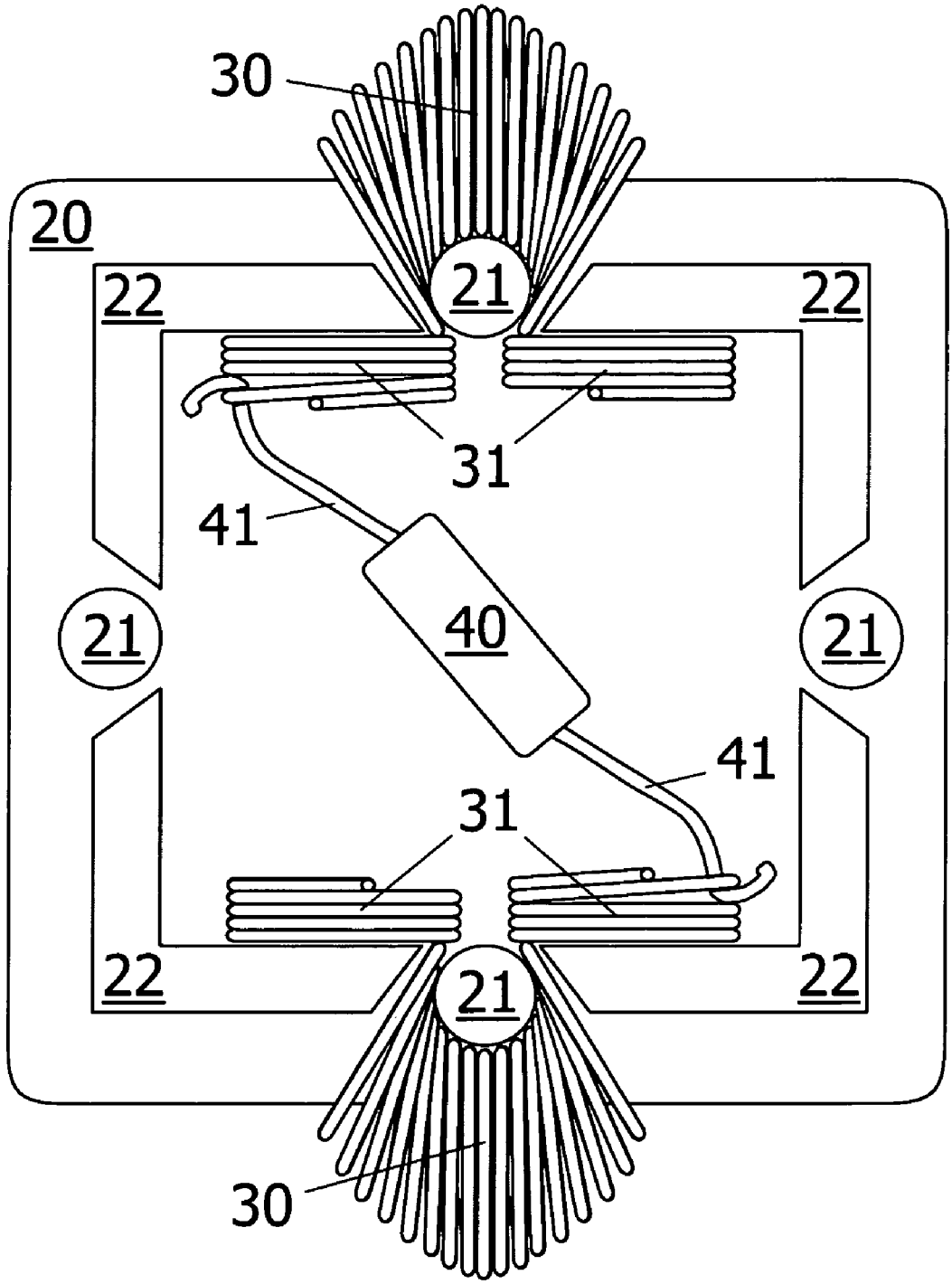
FIG. 2 shows a bottom view of an electrical circuit element housing and a resistor as an example circuit element.
Figure 3:
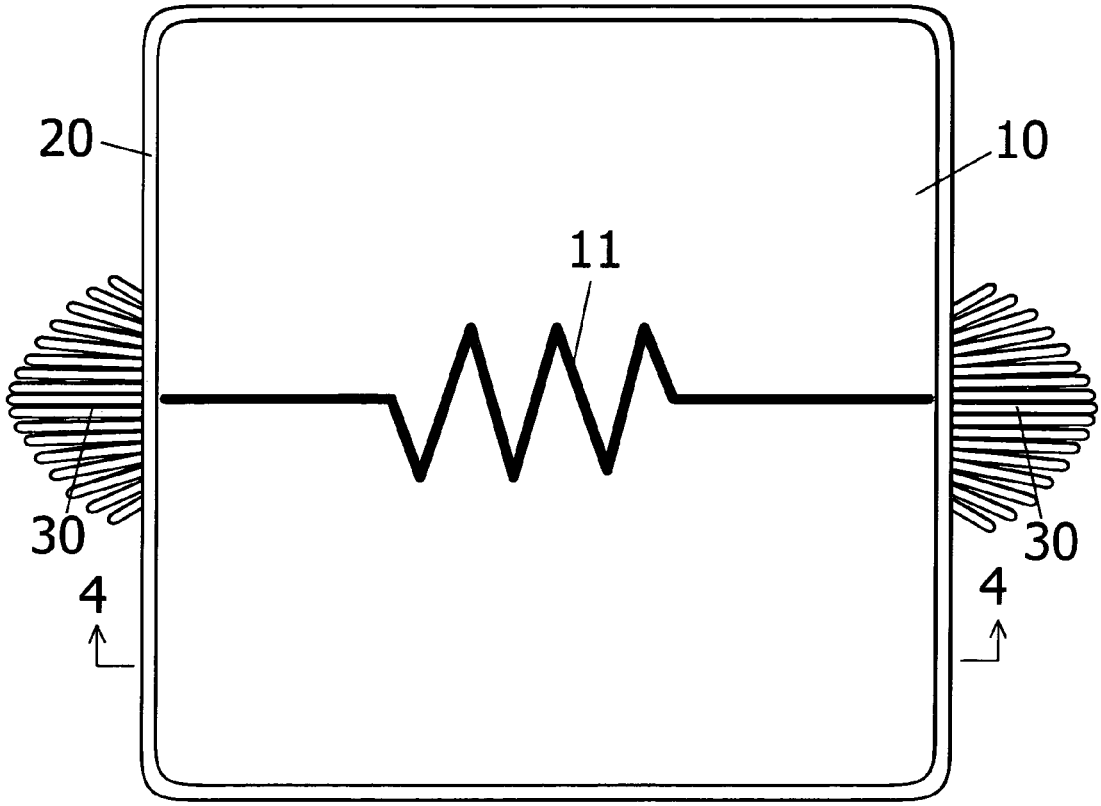
FIG. 3 shows a top view of an electrical circuit element housing depicting a resistor as the example circuit element and a section line reference for a sectional view in FIG. 4.
Figure 4:
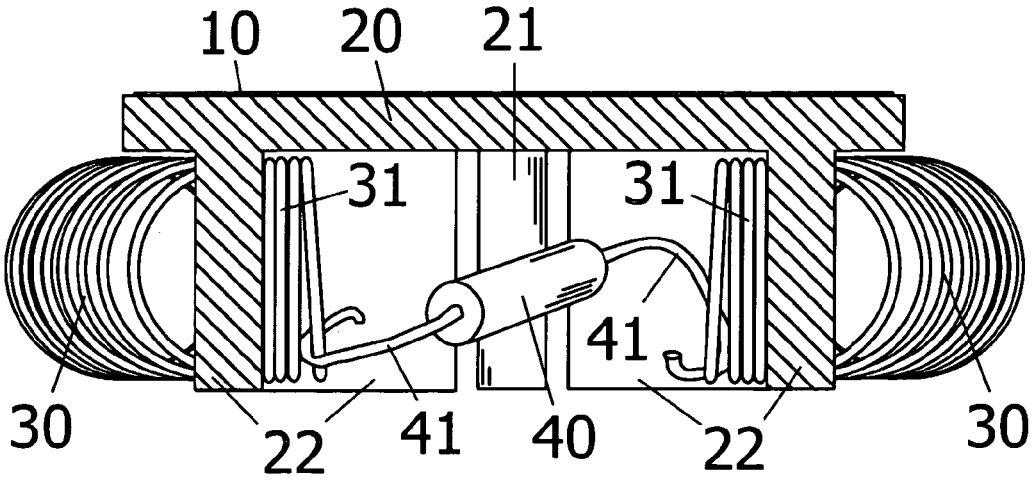
FIG. 4 shows a sectional view from the side of an electrical circuit element housing and a resistor as an example circuit element.

A preferred embodiment of the electrical circuit element housing of the present invention is illustrated in FIG. 1 (top view), FIG. 2 (bottom view), FIG. 3 (top view with section line reference for a sectional view), and FIG. 4 (sectional side view) featuring a resistor as an example.

FIG. 1 shows a top view of the electrical circuit element housing of the preferred embodiment of the present invention. A label 10 is displaying a resistor graphic 11. The label 10 is attached to an insulating housing top 20. The insulating housing top 20 width is the same as its height from the top view. The insulating housing top 20 is made of an electrically insulating material. In the preferred embodiment, the material is ABS (acrylonitrile butadiene styrene) plastic, but any electrically insulating material can be used, such as other plastics, glass, wood, etc. The label 10 is attached by an adhesive to the insulating housing top 20. Although the preferred embodiment uses an adhesive to attach the label 10 to the insulating housing top 20, any other form of representing the graphic 11 on the insulating housing top 20 can be used, such as printing the graphic 11 directly on the insulating housing top 20, etching the graphic 11 on the insulating housing top 20, forming the graphic 11 as a relief image of the same material as the insulating housing top 20, etc.

FIG. 1 also shows the resistor graphic 11 as a standard graphical depiction of a resistor typically used in schematic diagrams. The resistor graphic 11 has line segments which end at the edge of the graphic 11 and label 10 to coincide with the positions of bent coil connectors 30. The bent coil connectors 30 are constructed from a conducting resilient material shaped into a helical spring coil which is pinched to form an arc. The bent coil connectors 30 protrude fanned coil loops outward from where the line segments of the resistor graphic 11 end on the label 10 attached to the insulating housing top 20. The bent coil connectors 30 are also partially covered by the insulating housing top 20. Although the preferred embodiment features a bent coil as the protruding electrical connector, any electrical connector which can resiliently mate with itself can be used.

FIG. 2 shows a bottom view of the electrical circuit element housing of the preferred embodiment of the present invention. Each bent coil connector 30 is formed by pinching the helical spring coil conducting material around a guide post 21. The degree of bending in the bent coil connector 30 is determined by two guide walls 22 which pinch the coil around the guide post 21. The guide walls 22 are made of an insulating material. In the preferred embodiment, the guide walls 22 and the guide posts 21 are made from the same insulating material as the insulating housing top 20 and molded together into one insulating body. From the bottom view, the guide walls 22 are an L-like shape, and the guide posts 21 are cylindrical columns.

FIG. 2 also shows that there are four locations where the bent coil connectors 30 may be installed on the electrical circuit element housing. For the resistor example, only two of the four possible bent coil connector 30 positions are required and configured to be used. FIG. 2 also shows the guide posts 21 and the guide walls 22 in alternating positions under the insulating housing top 20. The resulting alternating placement of guide posts 21 and guide walls 22 is a square-like area where a circuit element 40 is housed.

FIG. 2 further shows the example circuit element 40 as a resistor. The circuit element 40 has a number of leads 41 which connect to bent coil connector binding posts 31. The bent coil connector binding posts 31 are ends of the bent coil connectors 30. The bent coil connector binding posts 31 are located in the square-like area formed by the alternating guide posts 21 and guide walls 22.

Even though FIG. 2 shows the bent coil connector binding posts 31 are part of the bent coil connector 30, there are other possibilities. The bent coil connector 30 can be a separate connector from the bent coil connector binding post 31 with just an electrical connection between them by way of solder, interlacing loops of coils, twisted connecting wires, etc. Each bent coil connector 30 is protruding externally from the resulting square area of the alternating guide posts 21 and guide walls 22. The bent coil connector 30 is installed on as many sides of the square to match the placement of the circuit element 40 inside the housing.

FIG. 3 shows a top view making reference of a location for a sectional view in FIG. 4 as indicated by section lines 4-4. FIG. 3 once again illustrates the label 10 with resistor graphic 11 attached to the insulating housing top 20. The bent coil connectors 30 are aligned with the orientation of the graphic 11.

FIG. 4 shows a sectional view from the side of the preferred embodiment of the present invention with the example resistor as the circuit element 40 being housed. The resistor circuit element 40 has two circuit element leads 41. Each circuit element lead 41 is inserted between loops of the bent coil connector binding posts 31. On opposite sides of the guide walls 22 from the bent coil connector binding posts 31 are the rest of bent coil connectors 30 external to the housing. FIG. 4 also shows height of the housing to accommodate the circuit element 40. Height of the guide posts 21 and the guide walls 22, is enough to sufficiently enclose the circuit element 40 and to match loop diameter of the bent coil connectors 30. The guide posts 21 and guide walls 22 are the same insulating material as the insulating housing top 20. The label 10 is shown to be attached to the top of the insulating housing top 20.

Three aspects of the present invention are configurable; the circuit element, the graphic, and the number of bent coil connectors. The circuit element can have up to four leads in the preferred embodiment. For each lead of the circuit element being used, a bent coil connector must be positioned in the electrical circuit element housing. Finally, the labeling of the housing needs to have the appropriate graphic representing the circuit element.

Figure 5:
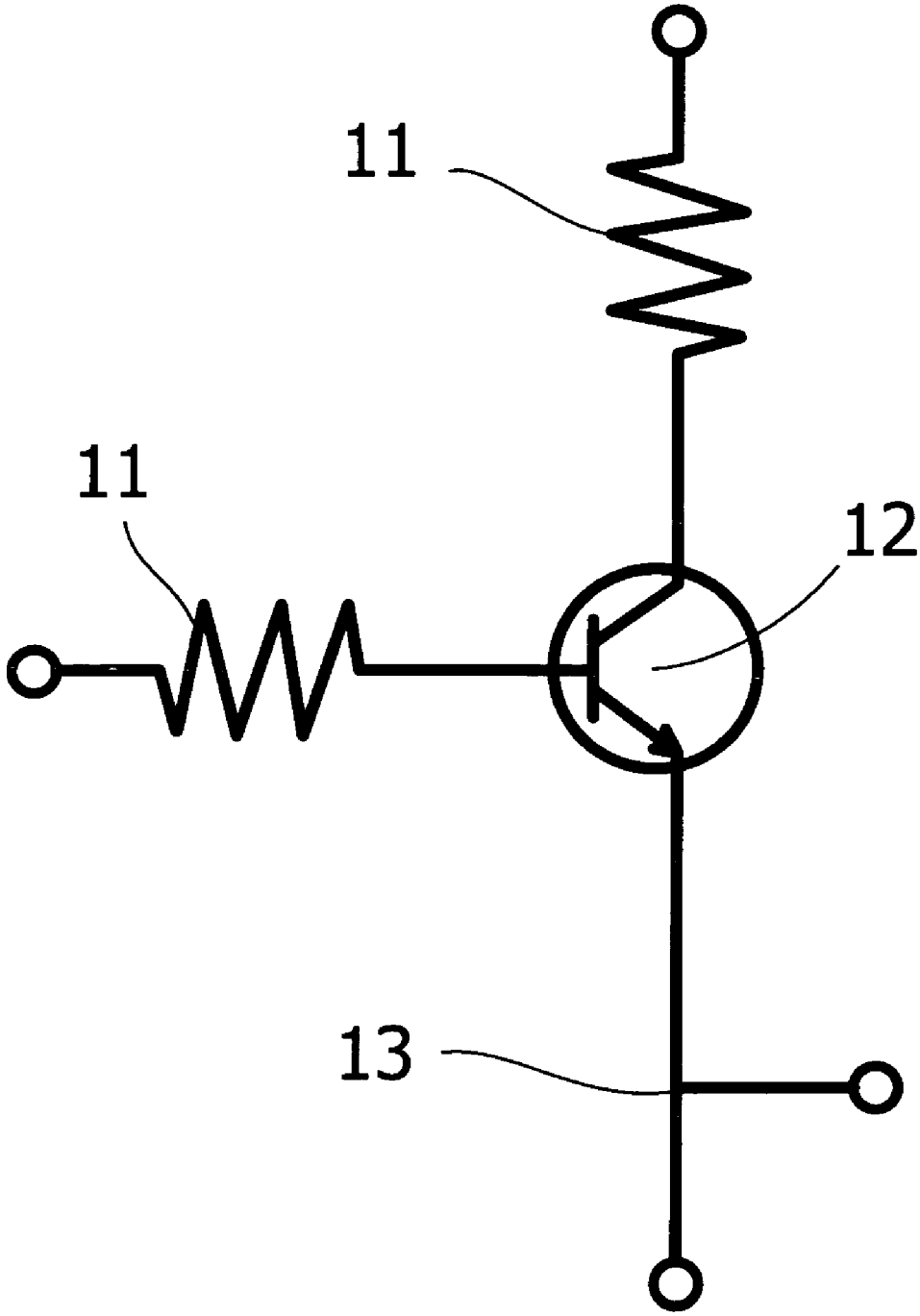
FIG. 5 shows a schematic diagram of a sample partial electric circuit.
Figure 6:
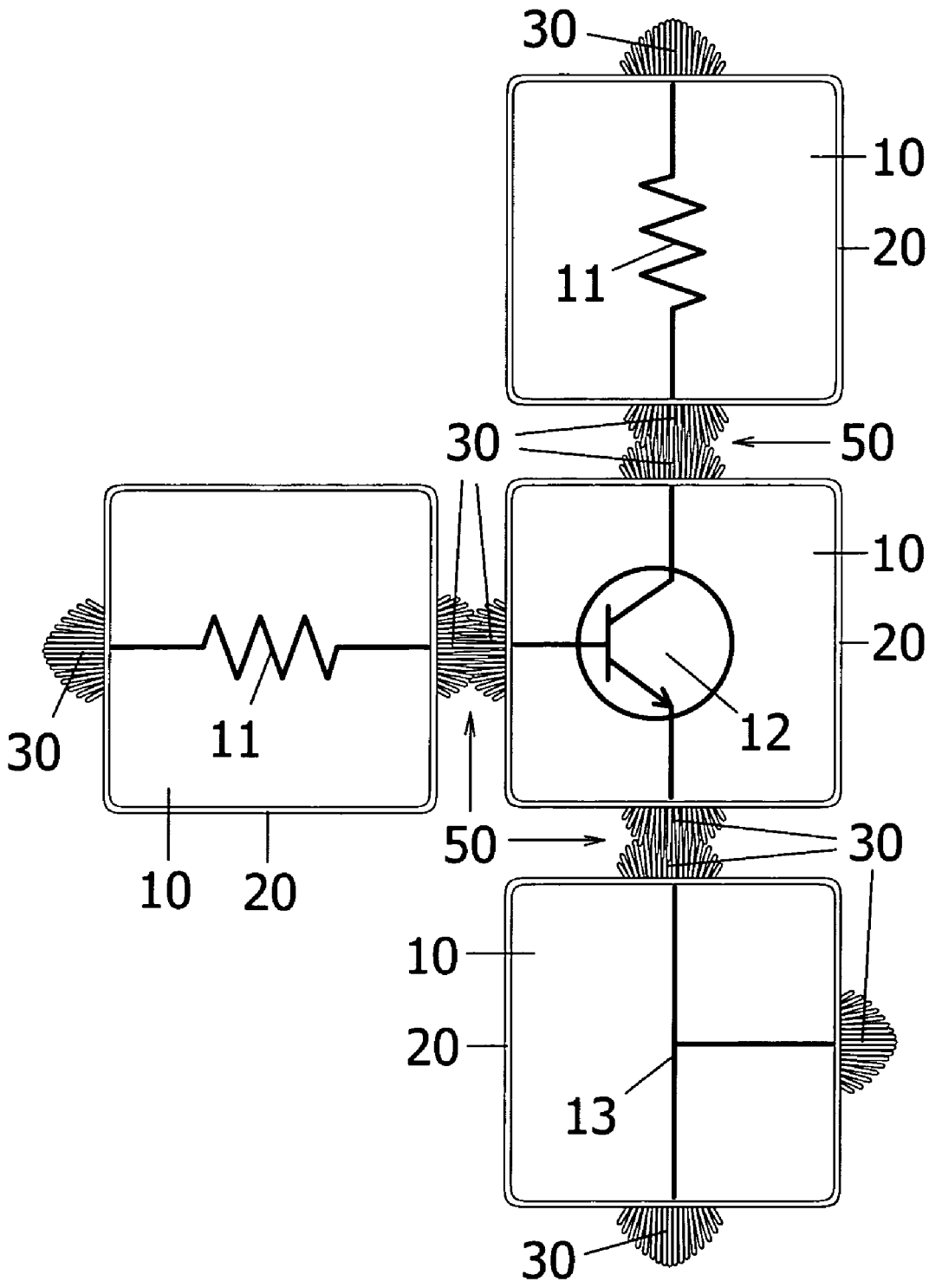
FIG. 6 shows a top view of a group of electrical circuit element housings combined so that a graphical depiction of the housing labels together reflects a schematic diagram of FIG. 5.

Operation—FIGS. 5 and 6

The manner of using the electrical circuit element housing of the present invention to build a circuit involves a series of steps. Namely, one places a desired electrical circuit element housing of the circuit element wanted on a surface where the circuit is being built. An intended adjoining circuit element in a similar housing is connected by inserting one of its bent coil connectors into the intended bent coil connector of the previous housing. This process is repeated in succession until the circuit is constructed.

FIG. 5 shows a sample partial circuit which can be constructed. Each circuit element of the circuit is shown with a graphic. There are two resistor graphics 11, a transistor graphic 12, and a three-conductors-tied-together graphic 13.

FIG. 6 shows the four housings used to prototype the sample partial circuit of FIG. 5. For each electrical circuit element housing of FIG. 6, a label 10 is shown on the insulating housing top 20. Then, depending on the type of circuit element, the label 10 shows either a resistor graphic 11, a transistor graphic 12, or three-conductors-tied-together graphic 13. The electrical circuit element housings are arranged such that the graphics of all the housings taken together combine to make the schematic diagram depicted in FIG. 5. The way the housings are interfaced is through inserting bent coil connectors 30 into adjacent bent coil connectors 30 of nearby electrical circuit element housings. Resulting connections of bent coil connectors 30 are bent coil connector couplings 50.

CONCLUSION, RAMIFICATIONS, AND SCOPE

Accordingly, the reader will see that the electrical circuit element housing of the present invention can be used to house a variety of electric circuit elements in a standardized housing with attractive label graphics and resilient connectors, and can be combined with similar such housings to construct electrical circuits easily and conveniently. Furthermore, the electrical circuit element housing has the additional advantages in that (a) when combined with similar such housings, it permits the building of an electric circuit from a schematic diagram;

(b) when combined with similar such housings, it permits deriving a schematic diagram from the combined label graphics of all the housings of a constructed electric circuit;

(c) when combined with similar such housings, it obviates the need for a breadboard or insulation board for assembling a prototype circuit;

(d) when interfaced with similar such housings, it permits easy insertion and extraction of such housings which facilitates ease in building, testing, and troubleshooting;

(f) when combined with similar such housings, it permits the resulting circuit to be constructed on the same plane without overlapping housings;

(g) it obviates the need for solder to house a circuit element;

(h) it does not change the underlying circuit element being housed when the housing is moved; it does not wear down the leads of the circuit element being housed since the leads once installed inside the housing do not change position;

(i) it does not require many external wires, if any, when constructing a circuit with similar such housings since wires can also be housed and connected together as a set of such housings;

(j) it permits configuring the housing to match the circuit element to the label graphic; and (k) it permits electrical probes and test clips to access test points easily by exposing portions of the connectors between housings of nearby circuit elements.

Although the description above contains many specificities, these should not be construed as limiting the scope of the invention but as merely providing illustrations of the presently preferred embodiment of this invention. For example, the shape of the insulated housing from a top view could be any shape that preserves a uniform distribution of connectors. Also, the number of bent coil connectors need not be limited to one per side if more complex circuit elements are to be house with leads that exceed the number described above. Additionally, whole circuits could be housed in a housing which spans in size multiple housings of the present invention formed into a desired shape. For example, a typical amplifying circuit could be placed in a housing that is four by two times bigger, fitted with the needed connectors, and configured with the appropriate label graphic.

Thus the scope of the invention should be determined by the appended claims and their legal equivalents, rather than by the examples given.

I claim:

1. An electrical connector used to interface two or more electrical circuits or parts of electric circuits comprising:

a helical coil of conducting material bent substantially lengthwise such that loops of said helical coil sufficiently fan out to accommodate inserting loops of a complementary helical coil connector between the loops of said helical coil to form an electrical connection, a plurality of guide members of insulating material sufficiently formed to substantially retain said helical coil, and a means for interweaving said loops of said helical coil with loops of a complementary helical coil connector to make an electric connection.

2. The electrical connector of claim 1 wherein said guide members are sufficiently shaped such that said helical coil can be connected with a complementary helical coil by pressure sensitive insertion.

3. The electrical connector of claim 1 wherein said means for joining said helical coil to said guide members forms binding posts disposed on the opposite side of said guide members from where said helical coils are bent.

4. The electrical connector of claim 1 wherein said guide members are part of electrical circuit element housings.

5. An electrical circuit element housing used as a basic building block for building and testing electric circuits comprising:

a circuit element having leads to make electrical contact wherein said circuit element is selected from the group consisting of resistors, capacitors, inductors, integrated circuits, switches, relays, transistors, thyristors, thermistors, potentiometers, and combinations of elements from said group, a graphic of said circuit element, a plurality of electrical connectors, an electrically insulating body of sufficiently hollow interior and of sufficient size to substantially surround said circuit element and having a plurality of predetermined electrical connector positions such that said electrical connectors may be placed in said predetermined electrical connector positions, a means of displaying said graphic on said electrically insulating body wherein said graphic is selected from the group of printed adhesive labels, temporary hand written markings, permanent hand written markings, carved etchings, plastic moldings, machine inked images, and combinations of such selections, a means for joining said electrical connectors in said predetermined electrical connector positions of said electrically insulating body such that said electrical connectors align with said graphic wherein said electrical connectors exterior to said electrically insulating body contains means to connect to sufficiently similar connectors as said electrical connectors exterior to said electrically insulating body wherein said electrical connectors exterior to said electrically insulating body are made from coils of conducting material fitted into said predetermined electrical connector positions of said electrically insulating body, and a means for attaching said circuit element inside of said electrically insulating body such that said circuit element makes electrical contact with said electrical connectors installed at the predetermined electrical connector positions of said electrically insulating body.

6. An electrical circuit element housing used as a basic building block for building and testing electric circuits comprising:

a circuit element having leads to make electrical contact wherein said circuit element is selected from the group consisting of resistors, capacitors, inductors, integrated circuits, switches, relays, transistors, thyristors, thermistors, potentiometers, and combinations of elements from said group, a graphic of said circuit element, a plurality of electrical connectors, an electrically insulating body of sufficiently hollow interior and of sufficient size to substantially surround said circuit element and having a plurality of predetermined electrical connector positions such that said electrical connectors may be placed in said predetermined electrical connector positions, a means of displaying said graphic on said electrically insulating body wherein said graphic is selected from the group of printed adhesive labels, temporary hand written markings, permanent hand written markings, carved etchings, plastic moldings, machine inked images, and combinations of such selections, a means for joining said electrical connectors in said predetermined electrical connector positions of said electrically insulating body such that said electrical connectors align with said graphic wherein said electrical connectors exterior to said electrically insulating body contains means to connect to sufficiently similar connectors as said electrical connectors exterior to said electrically insulating body wherein said electrical connectors exterior to said electrically insulating body are made from coils of conducting material fitted into said predetermined electrical connector positions of said electrically insulating body such that said coils are helical in shape and bent lengthwise to form arcs exterior to said electrically insulating body, and a means for attaching said circuit element inside of said electrically insulating body such that said circuit element makes electrical contact with said electrical connectors installed at the predetermined electrical connector positions of said electrically insulating body.

7. An electrical circuit element housing used as a basic building block for building and testing electric circuits comprising:

a circuit element having leads to make electrical contact wherein said circuit element is selected from the group consisting of resistors, capacitors, inductors, integrated circuits, switches, relays, transistors, thyristors, thermistors, potentiometers, and combinations of elements from said group, a graphic of said circuit element, a plurality of electrical connectors, an electrically insulating body of sufficiently hollow interior and of sufficient size to substantially surround said circuit element and having a plurality of predetermined electrical connector positions such that said electrical connectors may be placed in said predetermined electrical connector positions, a means of displaying said graphic on said electrically insulating body wherein said graphic is selected from the group of printed adhesive labels, temporary hand written markings, permanent hand written markings, carved etchings, plastic moldings, machine inked images, and combinations of such selections, a means for joining said electrical connectors in said predetermined electrical connector positions of said electrically insulating body such that said electrical connectors align with said graphic wherein said electrical connectors exterior to said electrically insulating body contains means to connect to sufficiently similar connectors as said electrical connectors exterior to said electrically insulating body wherein said electrical connectors exterior to said electrically insulating body are made from coils of conducting material fitted into said predetermined electrical connector positions of said electrically insulating body such that said coils are helical in shape and bent lengthwise to form arcs exterior to said electrically insulating body while interior to said electrically insulating body said electrical connectors contain means to extend said coils to form binding post connectors, and a means for attaching said circuit element inside of said electrically insulating body such that said circuit element makes electrical contact with said binding posts internal to said electrically insulating body as part of said electrical connectors installed at the predetermined electrical connector positions of said electrically insulating body.

8. A method of building electrical circuits comprising:

selecting circuit elements to form a circuit, said circuit elements being housed each within their own electrical circuit element housing with each of the housings comprising a graphic of a circuit element, an insulating housing, and a plurality of conducting helical coil electrical connectors sufficiently bent and placed in predetermined positions around an exterior of the housing such that the electrical connectors align with said graphic, and arranging said electrical circuit element housings of the said circuit elements selected by a means of sufficiently interfacing said electrical circuit element housings such that interweaving loops of the electrical connectors of adjacent electrical circuit element housings form an electrical contact and all of said graphics of the housings taken together form a schematic drawing.

9. The method of building electrical circuits of claim 8 wherein said selecting of said circuit elements is taken from an original circuit schematic drawing and said schematic drawing of said arranging of the housed circuit elements matches said original circuit schematic drawing.

* * * * *